US005170187A

United States Patent [19]

Oikawa

[11] Patent Number: 5,170,187

[45] Date of Patent: Dec. 8, 1992

[54] INK SUPPLY MECHANISM FOR A THERMAL INK-JET RECORDING APPARATUS

[75] Inventor: Shinro Oikawa, Tokyo, Japan

[73] Assignee: NEC Corporation, Tokyo, Japan

[21] Appl. No.: 666,115

[22] Filed: Mar. 6, 1991

[30] Foreign Application Priority Data

Mar. 6, 1990 [JP] Japan ..... 2-52787

[51] Int. Cl.[5] ..... B41J 2/175; B41J 27/00

[52] U.S. Cl. ..... 346/140 R; 346/76 PH; 400/198

[58] Field of Search ..... 346/140, 1.1, 76 PH, 346/76 R; 400/198; 118/202

[56] References Cited

U.S. PATENT DOCUMENTS 3,719,261 3/1973 Heinzer ..... 346/140 X
4,801,951 1/1989 Shimazaki ..... 346/140

FOREIGN PATENT DOCUMENTS 58-65686 4/1983 Japan ..... 400/198
62-17865 8/1987 Japan ..... 400/198
63-15178 6/1988 Japan ..... 400/198

*Primary Examiner*—Joseph W. Hartary
*Attorney, Agent, or Firm*—Sughrue, Mion, Zinn Macpeak & Seas

[57] ABSTRACT

A thermal ink jet recording apparatus includes an ink film (21) having a plurality of apertures (22) for retaining ink and movable along a path in the form of a loop, the ink film having an electrical resistance material (35) extending in a direction perpendicular to the path. A thermal head (3) contacts one of opposite surface of the ink film for applying heat to it corresponding to a pattern to be printed. An ink container (26) is located on the path upstream of the thermal head (3) and contains solid ink which melts when heated, and a device is provided for applying a voltage across the edges of the ink film. In this manner, the heated ink film causes the ink to melt thereby filing apertures (22). The ink film (21) has first and second opposite surfaces. In the first embodiment, the first surface and opposite edge portions of the ink film on both surfaces have an electrical resistance layer (35) while the remaining portions of the second surface have an insulating layer (34). In another embodiment, stripe-like electrical resistance layers (37*a*, 37*b*, 37*c*) are provided on the first surface and on opposite edge portions of the second surface. Finally, in another embodiment, electrical resistance layers (39*a*, 39*b*, 39*c*) are provided on the first surface and on opposite edge portion of the second surface, the resistance layers on the second surface being displaced relative to the electrical resistance layers on the first surface.

6 Claims, 4 Drawing Sheets

INK SUPPLY MECHANISM FOR A THERMAL INK-JET RECORDING APPARATUS

BACKGROUND OF THE INVENTION

The present invention relates to a thermal ink-jet recording apparatus having an ink film whose surface has a number of holes for retaining ink, and a thermal head contacting the ink film in a print position for ejecting the ink out of the holes toward a recording sheet. More particularly, the present invention relates to a mechanism for supplying ink to the holes of the film after a printing operation.

A thermal ink-jet recording apparatus of this type is disclosed in U.S. patent application Ser. No. 07/482,097 invented by the same inventor as the present invention. The conventional apparatus has an ink film formed with a number of holes for transporting liquid ink to a thermal head, and an ink reservoir filled with ink to be supplied to the ink film. The ink film is immersed in the liquid ink in the reservoir to be supplied with the ink.

U.S. Pat. No. 4,801,951 teaches a thermal ink-jet recording apparatus having a pair of spools around which an ink film is wound. The ink film is movable in a reciprocating motion over a thermal head which is located between the spools. The ink film is supplied with ink by being pressed against felt members which is impregnated with liquid ink.

A prerequisite of the conventional thermal ink-jet recording apparatuses be that liquid ink is stored in a reservoir and, therefore, the reservoir requires a structure for preventing ink from flowing out of the reservoir and ink paths. As a result, the ink supply mechanism including the reservoir is bulky, causing the entire recording apparatus to be bulky. In addition, the ink supply mechanism is apt to introduce impurities in the liquid ink and thereby deteriorate it since the ink is held and circulated in a liquid state.

SUMMARY OF THE INVENTION

It is, therefore, an object of the present invention to provide a thermal ink-jet recording apparatus having a simple ink supply mechanism.

It is another object of the present invention to provide a thermal ink-jet recording apparatus which causes ink to undergo a minimum of deterioration.

A thermal ink-jet recording apparatus of the present invention comprises an ink film having a plurality of apertures for retaining ink therein and movable in a first direction along a path in the form of a loop. The ink film has an electric resistance material extending in a second direction which is substantially perpendicular to the first direction. A thermal head contacts one of opposite surfaces of the ink film for selectively applying heat to the ink film corresponding to a pattern to be recorded. An ink container is located on the path upstream of the thermal head with respect to the first direction and contains a solid ink therein which melts when heated. The ink container has an opening extending in the second direction and presses the solid ink against the ink film at the opening. Means is provided for applying different voltages to opposite edge portions of the ink film in the second direction.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
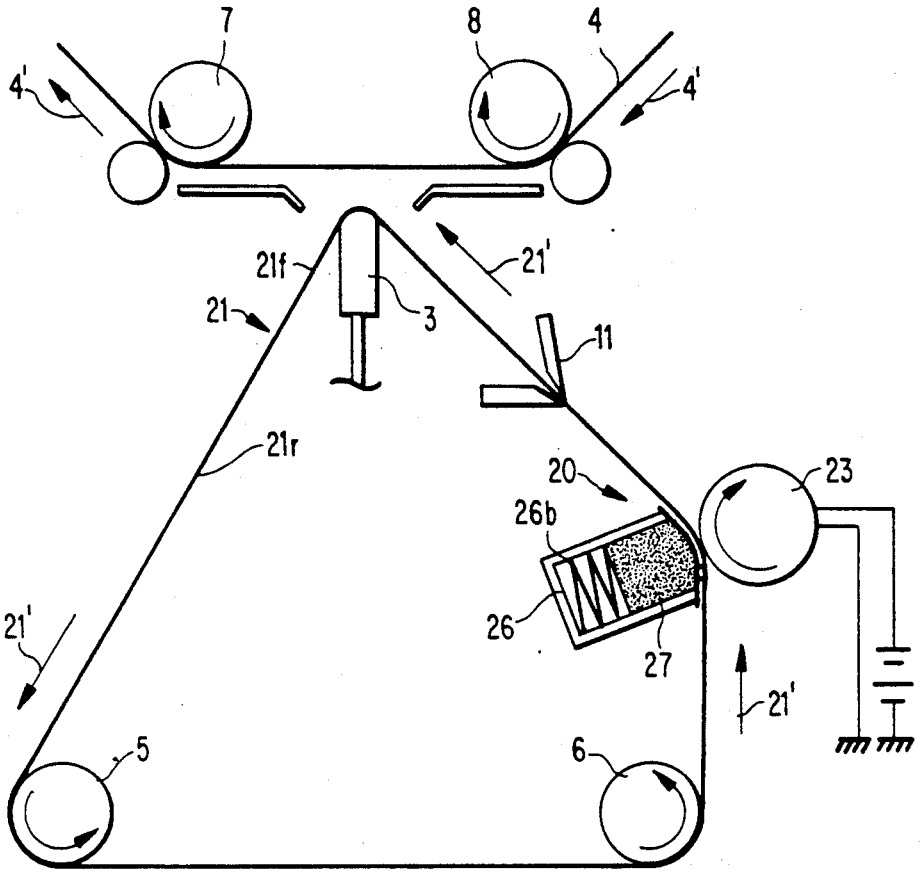
FIG. 1 schematically shows a preferred embodiment of the thermal ink-jet recording apparatus in accordance with the present invention.
Figure 3:
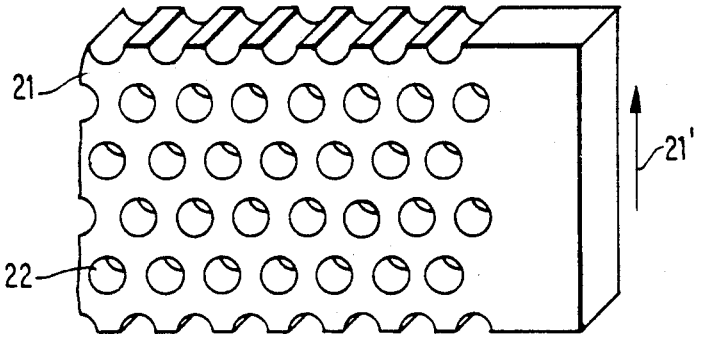
FIG. 3 is a sectional perspective view showing a specific structure of an ink film applicable to the FIG. 1 embodiment.

Referring to FIG. 1 of the drawings, a thermal ink-jet recording apparatus embodying the present invention has an endless ink film 21 which is formed with a number of small through holes or apertures 22 (FIG. 3). The ink film 21 is passed over drive rollers 5 and 6 in a circular configuration and driven by the rollers 5 and 6 at a constant speed in a direction indicated by an arrow 21'. A thermal head 3 has a plurality of heating elements, not shown, arranged substantially perpendicularly to the direction 21' in which the ink film 21 moves. The heating elements contact a rear surface 21*r* of the ink film 21. A recording sheet 4 is transported by rollers 7 and 8 to a print position, where it faces the thermal head 3, in a direction indicated by an arrow 4'. An ink supply mechanism 20 is located upstream of the thermal head 3 with respect to the moving direction 21' of the ink film 21 so as to supply ink to the apertures 22 of the ink film 21. A scraper 11 is disposed between the thermal head 3 and the ink supply mechanism 20 to remove excess ink from the front and rear surfaces 21*f* and 21*r* of the ink film 21.

Figure 2:
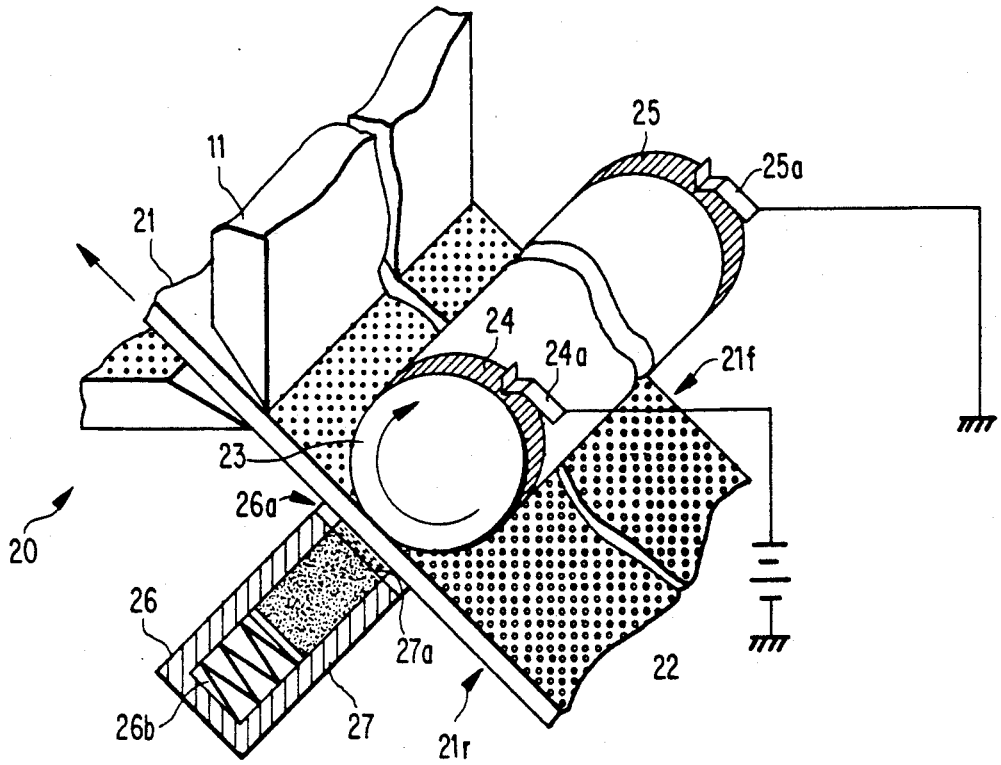
FIG. 2 is a perspective view showing an ink supply mechanism included in the FIG. 1 embodiment.

As shown in FIG. 2, the ink supply mechanism 20 has an ink container 26 storing a ink which is in solid form 27 which liquefies when heated. The ink container 26 has an opening 26*a* which faces the rear surface 21*r* of the ink film 21 and extends in the widthwise direction of the ink film 21 which is substantially perpendicular to the direction 21'. A spring or similar biasing member 26*b* constantly biases the solid ink 27 such that the ink 27 protrudes from the opening 26*a* and presses itself against the rear surface 21*r* of the ink film 21. An idle roller 23 is positioned to face the ink container 26 and extends in the widthwise direction of the ink film 21 over substantially the entire width of the latter. The solid ink 27 is pressed against the idle roller 23 by spring 26*b* with the ink film 21 disposed between the roller and the solid ink 27.

Conductive layers 24 and 25 are provided on axially opposite ends of and along the circumference of the idle roller 23 so as to be in contact with opposite edges of the ink film 21. Electrode plates 24*a* and 25*a* are held in sliding contact with the conductive layers 24 and 25, respectively. The electrode plate 24*a* is connected to a positive voltage source while the electrode 25*a* is connected to ground, so that different voltages are applied to opposite edges of the ink film 21.

Referring FIG. 3, the ink film 21 is made of an electric resistance material such as Ni-Cr, Ta and Ta compound and, therefore, generates heat when applied with a voltage difference at opposite edges thereof via the electrode plates 24*a* and 25*a* and conductive layers 24 and 25. The heated film melts the solid ink 27 which is held in contact with the ink film 21. As illustrated in FIG. 2 the resulting liquid ink 27*a*, fills in the apertures 22 of the ink film 21 by capillary. Directly heating the ink film 21 which contacts the solid ink 27 is successful in effecting recording in a short period of time after applying the voltage difference to both edges of the film 21.

Referring again to FIG. 1, the ink film 21, supplied with the liquid ink by the mechanism 20, is driven in the direction 21' while the scraper 11 removes excessive ink from the front surface 21*f* and rear surface 21*r* of the film 21. When the ink film 21 had carried the liquid ink to the print position, the thermal head 3 is heated corresponding to a pattern to be printed by a conventional method as is disclosed in U.S. Pat. No. 4,608,577.

Specifically, while the ink film 21 runs in contact with the thermal head 3, current, representative of a given pattern, is supplied to the thermal head 3 to heat it. As a result, a low boiling point component of the liquid ink 27*a* evaporates to produce bubbles. By the pressure of the bubbles, the liquid ink 27*a* is ejected from the apertures 22 onto the recording sheet 4 which faces the ink film 21 with a small gap therebetween, whereby spots are formed on the recording sheet 4. It is noteworthy that the apertures 22 do not correspond one-to-one to the heating elements in the thermal head 3 and have a density higher than the recording density. That is, drops of ink ejected from a plurality of apertures 22 cooperate to form a single spot on the recording sheet 4. Hence, even when some of the apertures 22 are stopped and fail to eject ink, a uniform recoding is obtainable with high reliability.

After the ink film passes the thermal head 3, the apertures 22 of the ink film 21 have selectively lost the ink. The ink film 21 is again driven to the ink supply mechanism 20 to fill such apertures 22 with ink.

Figure 4A:
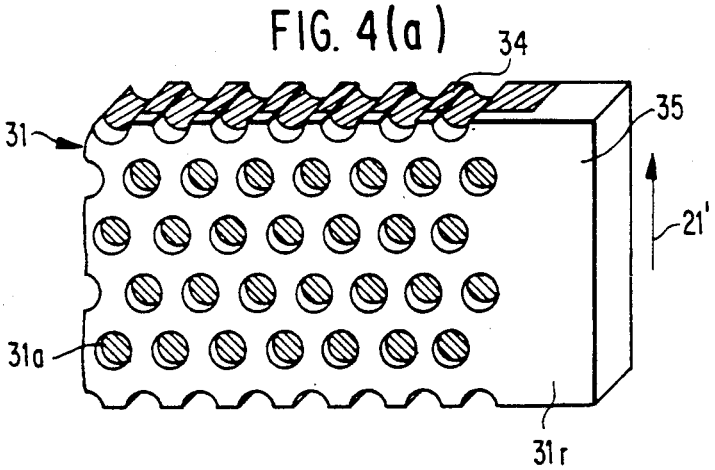
FIGS. 4(*a*) and 4(*b*) are sectional perspective views showing another specific structure of the ink film.
Figure 4B:
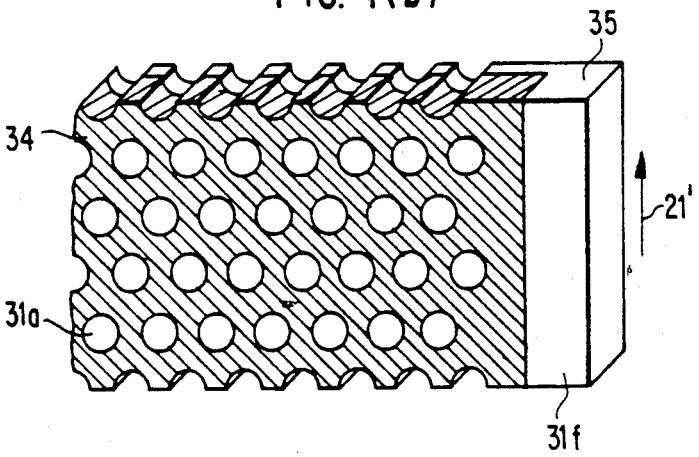

FIGS. 4(*a*) and 4(*b*), 5(*a*) and 5(*b*) and 6(*a*) and 6(*b*) each shows specific configurations of the ink film.

FIGS. 4(*a*) and 4(*b*) are sectional perspective views showing respectively a rear surface 31*r* and a front surface 31*f* of an ink film 31. The ink film 31 has an insulating layer 34 made of polyimide or polyester, for example, and an electric resistance layer 35. The ink film 31 has such a double layer structure except for opposite edge portions thereof with respect to the direction perpendicular to the moving direction 21' of the film 31. Specifically, the opposite edge portions of the ink film 31 which contact the conductive layers 24 and 25 of the roller 23 are constituted only by the resistance layer 35. A number of small apertures 31*a* are formed through the double-layer portion of the ink film 31. The ink film 31 having such a structure has greater mechanical strength than the ink film 21 shown in FIG. 3.

Figure 5A:
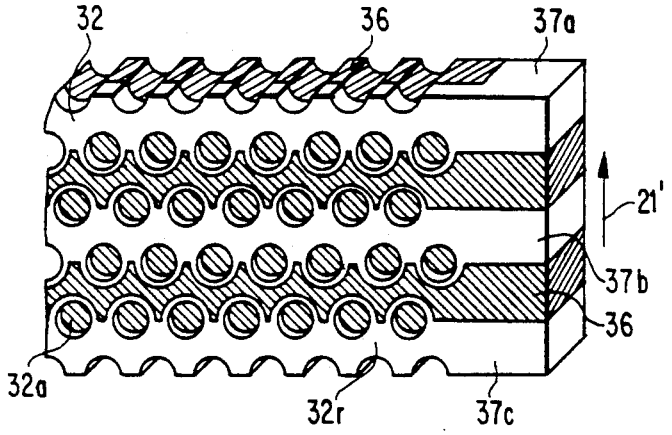
FIGS. 5(*a*) and 5(*b*) are sectional perspective views showing still another specific structure of the ink film.
Figure 5B:
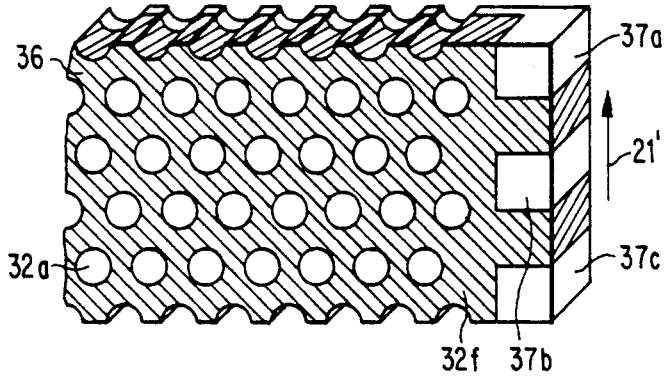

FIGS. 5(*a*) and 5(*b*) respectively show a rear surface 32*r* and front surface 32*f* of an ink film 32. As shown, electric resistance layers 37*a* to 37*c* in the form of stripes are provided on the rear surface 32*r* of the ink film 32 to extend in the widthwise direction of the film 32, the other part of the rear surface 32*r* being constituted by an insulating layer 36. The resistance layers 37*a* to 37*c* extend to widthwise edge portions of the front surface 32*f* of the ink film 32 so as to contact the conductive layers 24 and 25 of the roller 23. Further, on the rear surface 32*r* of the ink film 32, the resistance layers 37*a* to 37*c* each surrounds the associated array of apertures 32*a*. In this configuration, current is fed only to the stripe-like resistance layers 37*a* to 37*c*, so that the thermal response is rapid and the power consumption is low.

Figure 6A:
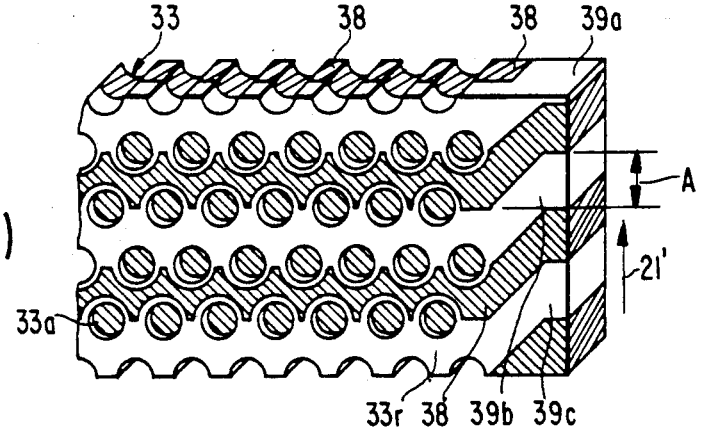
FIGS. 6(*a*) and 6(*b*) are sectional perspective views showing a further specific structure of the ink film.
Figure 6B:
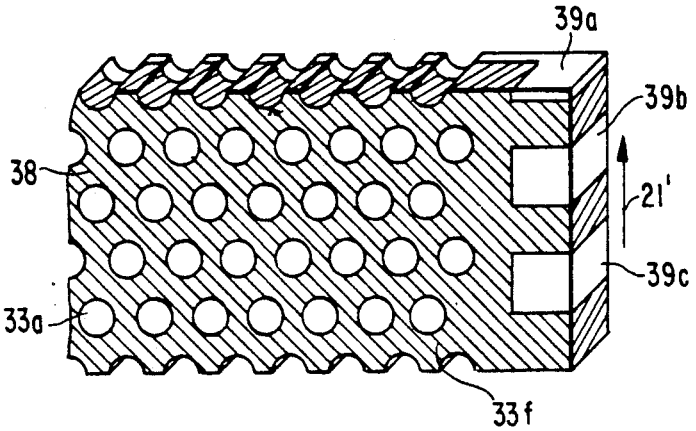

FIGS. 6(*a*) and 6(*b*) respectively show a rear surface 33*r* and a front surface 33*f* of an ink film 33. As shown, the ink film 33, like the ink film 32 of FIGS. 5(*a*) and 5(*b*), have electric resistance layers 39*a* to 39*c* in the form of stripes on the rear surface 33*r* thereof. However, the difference is that the resistance layers 39*a* to 39*c* each extends to the front surface 33*f* while being bent in the moving direction 21' of the ink film 33 by a distance A. The rest of the configuration is the same as the ink film 32. In this configuration, before the apertures 33*a* corresponding to the resistance layers 39*a* to 39*c* reach the solid ink 27, the peripheral portions of the apertures 33*a* starts heating. Such apertures 33*a*, therefore, arrive at the solid ink 27 after the resistance layers 39*a* to 39*c* have been sufficiently heated. It follows that the liquefied ink 27*a* is surely filled in the apertures 33*a* to promote rapid printing, i.e., rapid ejection of the ink film 33.

Figure 7A:
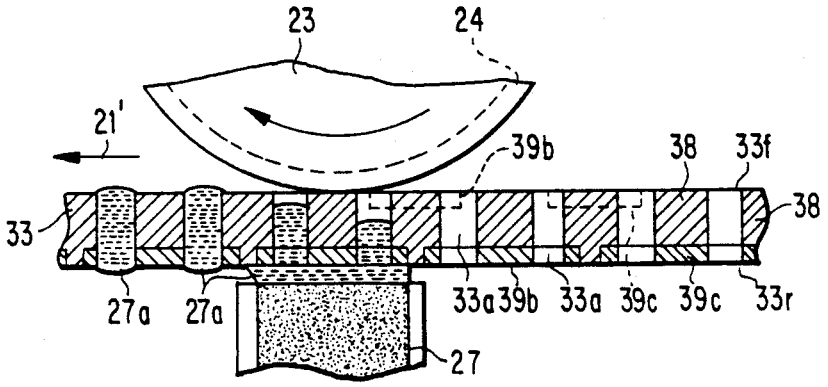
FIGS. 7(*a*) to 7(*c*) are sectional views showing an ink filling process effected with the ink film shown in FIGS. 6(*a*) and 6(*b*).
Figure 7B:
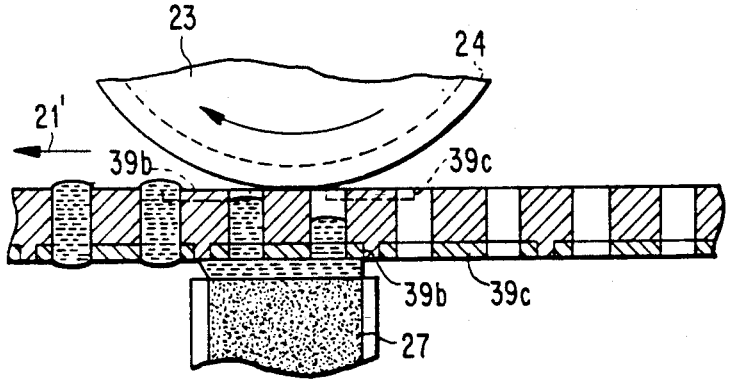
Figure 7C:
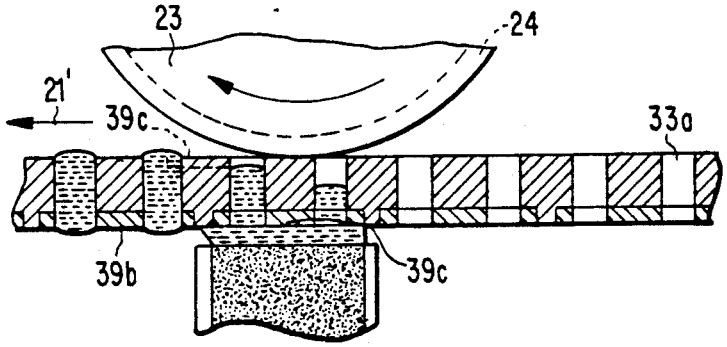

Referring to FIGS. 7(*a*) to 7(*c*), an ink filling process using the ink film 33 shown in FIGS. 6(*a*) and 6(*b*) and the recording apparatus shown in FIG. 1 will be described.

When a stripe electrode 39*b* provided on the front surface 33*f* of the film 33 begins to contact the electrode 24 of the roller 23 (FIG. 7(*a*)), current flows through the stripe electrode 39*b* to start generating heat. At this time, the apertures 33*a* associated with the electrode 39*b* on the rear surface 33*r* of the film 33 have not yet reached the solid ink 27.

As the ink film 33 is further moved in the direction 21', the apertures 33*a* associated with the electrode 39*b* on the rear surface 33*r* reach the solid ink 27 (FIG. 7(*b*)). Since the electrode 39*b* is heated to a temperature high enough to melt the solid ink 27 while the ink film 33 moves from the position of FIG. 7(*a*) to the position of FIG. 7(*b*), the solid ink 27 is liquefied by the electrode 39*b* and the resulted liquid ink 27*a* enters the apertures 33*a* (FIG. 7(*c*)).

While the invention has been described in reference to a number of preferred embodiments, it is understood that various modifications will become possible for those skilled in the art after receiving the teachings of the present disclosure without departing from the scope thereof.

What is claimed is:

1. A thermal ink-jet recording apparatus comprising:

an ink film having a plurality of apertures for retaining ink therein and movable in a first direction along a path in the form of a loop, said ink film having an electrical resistance material extending at least in a second direction which is substantially perpendicular to said first direction;

a thermal head for contacting one of opposite surfaces of said ink film for selectively applying heat to said ink film corresponding to a pattern to be printed;

an ink container located on said path upstream of said thermal head with respect to said first direction and containing solid ink which melts when heated, said ink container having an opening extending in said second direction and means for pressing said solid ink against said ink film at said opening;

means for applying a voltage difference to opposite edge portions of said ink film in said second direction; and an idle roller facing said ink container and holding said ink film in cooperation with said ink container therebetween, wherein said roller has a width substantially equal to a width of said ink film in said second direction, and wherein said applying means includes a pair of conductive layers provided on opposite end portions of said idle roller in said second direction so as to be in contact with said opposite edge portions of said ink film.

2. An apparatus as claimed in claim 1, wherein said ink film has a first surface contacting said thermal head and a second surface opposite to said first surface, said first surface and said opposite edge portions of said ink film being constituted by an electric resistance layer while said second surface being constituted by an insulating layer except for said opposite edge portions.

3. An apparatus as claimed in claim 1, wherein said ink film has a first surface contacting said thermal head and a second surface opposite to said first surface, a plurality of stripe-like electric resistance layers being provided on said first surface and opposite edge portions of said second surfaces, said electric resistance layers being alternatingly disposed with an insulating layer.

4. An apparatus as claimed in claim 3, wherein said electric resistance layers on said second surface are displaced in said first direction relative to said electric resistance layers on said first surface.

5. The apparatus of claim 4, wherein said plurality of apertures are surrounded by said electrical resistance layers.

6. The apparatus of claim 1, wherein said plurality of apertures are surrounded by said electrical resistance layers.

* * * * *